US005129005A

United States Patent [19]

Zwicky et al.

[11] Patent Number: 5,129,005

[45] Date of Patent: Jul. 7, 1992

[54] ELECTRODYNAMIC LOUDSPEAKER

[75] Inventors: Paul Zwicky; Roger Schultheiss, both of Dielsdorf, Switzerland

[73] Assignee: Studer Revox AG, Regensdorf, Switzerland

[21] Appl. No.: 379,824

[22] Filed: Jul. 14, 1989

[30] Foreign Application Priority Data

Jul. 15, 1988 [CH] Switzerland ..... 2727/88

[51] Int. Cl.[5] ..... H04R 3/00

[52] U.S. Cl. ..... 381/96; 281/100

[58] Field of Search ..... 381/96, 99, 100

[56] References Cited

U.S. PATENT DOCUMENTS 4,118,600 10/1978 Stahl ..... 381/98
4,137,510 1/1979 Iwahara .
4,340,778 7/1982 Cowans et al. .

FOREIGN PATENT DOCUMENTS 0221324 9/1986 European Pat. Off. .
2141141 2/1973 Fed. Rep. of Germany ..... 381/96
892396 4/1944 France .
2345880 10/1977 France .
2378418 8/1978 France .
81/02501 3/1981 PCT Int'l Appl. .
0659066 10/1951 United Kingdom ..... 381/96

OTHER PUBLICATIONS

Clements, Warner "A New Approach to Loudspeaker Damping" Audio Engineering Aug. 1951 pp. 20–22, and 54–55.

*Primary Examiner*—Forester W. Isen
*Attorney, Agent, or Firm*—Egli International

[57] ABSTRACT

In a loudspeaker with a number of speaker units, each connected across one power amplifier to a diplexer, the power amplifiers having negative source impedance ($-R_1$) are utilized. The diplexer includes an adder circuit and a filter connected thereto. The power amplifiers with negative source impedance reduce the linear distortions to such an extent that the use of modern diplexers is possible and further measures for reducing nonlinear distortions are appropriate.

17 Claims, 5 Drawing Sheets

ELECTRODYNAMIC LOUDSPEAKER

BACKGROUND OF THE INVENTION

The present invention relates to an electrodynamic or moving-coil loudspeaker.

Electrodynamic loudspeakers of the type under discussion have been known. For example, DE-A-27 13 023 discloses an electrodynamic loudspeaker with an amplifier for feeding a moving or voice coil. The loudspeaker is constructed as a low-frequency speaker or woofer. The effective output impedance of the amplifier is equivalent to a negative resistance connected in series with an anti-resonant circuit. The negative resistance has substantially the same value as the resistance of the speaker moving coil. Through operating the speaker with such an amplifier, it is possible to modify the bass characteristics of the speaker, which is equivalent to modifying the mechanical parameters of the speaker component, as well as its moving mass, damping and modulation. Thus, in this way the self-resonant frequency of the speaker is controlled and simultaneously another resonant frequency is forced, which is better tuned to the speaker casing.

The disadvantage of this solution is that, although it brings advantages in the case of woofers or on reproducing bass notes by another speaker, it cannot be used for improving medium frequency and high frequency speakers or tweeters, or for improving the reproduction of medium and high frequency notes, because in the case of the latter said problems with the self-resonant frequency either do not occur, or only occur to a very limited extent. In addition, this solution does not provide a foreseeable frequency response indicating a clear tendency and such as is required for other components (e.g. amplifiers, recording equipment, etc.) of an electroacoustic chain. Therefore the speaker remains the poorest component of such a chain, which starts with the microphone and ends with the speaker. In the case of the speaker the linear and nonlinear distortions are much worse than in the other components of such an electroacoustic chain, such as e.g. the microphone, amplifier, mixer, memory, etc. The improvements achieved with the measures according to the aforementioned patent application and other known measures are of such a minor nature that they often do not justify the expenditure.

In the article published in Audio-Engineering, August, 1951, by W. Clements entitled "A new approach to loudspeaker damping", an amplifier circuit with a negative impedance is disclosed, which is designed in such a way that as a result, the impedance of the moving coil of a following speaker almost disappears. The advantage aimed at is that the speaker will be very considerably damped.

Thus, an amplifier circuit of the type described in the above article is in particular intended for use for damping resonances of the speaker at low frequencies. In the case of multipath loudspeakers the resonant frequency is only in the transmission range for woofers. In the case of medium-frequency speakers and tweeters said resonant frequency is outside the transmission range. In the case of multipath systems such an amplifier circuit is consequently exclusively used as a drive for woofers. The frequency response is not improved by such an amplifier circuit in the case of medium-frequency speakers and tweeters, because other means are used for this purpose.

SUMMARY OF THE INVENTION

It is an object of the present invention to provide an electrodynamic loudspeaker, in which distortions occurring during the movement of the diaphragm arm are considerably reduced over the entire audible frequency range.

The advantages resulting from the invention are essentially that the loudspeaker now has a constantly rising straight frequency response over its entire frequency range. Thus, a mathematically ideal situation is obtained, making it possible with the aid of a correcting network containing an integrator and which is connected upstream of the power amplifier to produce a straight, horizontal frequency response. It is also advantageous that the thus obtained frequency response is phase-linear, i.e. has a linear relationship between the phase and the frequency and which can be easily foreseen over all the frequencies. Although according to the aforementioned DE-A-27 13 023, power amplifiers with negative impedance are known for woofers, a surprising and hitherto unused effect occurs if such a power amplifier is multiply combined in a multipath speaker, together with a speaker dividing network or diplexer. This effect resides in the aforementioned frequency and phase response having foreseeable, constant characteristics over the entire transmission range. Once it has proved possible according to the invention to make the frequency response straight and phase-linear over the entire frequency range, further possibilities are provided enabling multipath systems to be significantly improved.

However, such improvements only come fully into effect when the frequency and phase response is sufficiently well and reliably known. Such improvements can be achieved in the magnetic systems of speaker units and in diplexers. For example, further proposed measures for linearizing the driving force of the moving coil in the magnetic field of the magnetic system only come into effect if the nonlinearities of the restoring forces have already been damped in accordance with the invention. Although certain of the aforementioned improvements are known per se, the action thereof is surprisingly increased if carried out on speakers driven by power amplifiers with a negative source impedance.

The invention is described in greater detail hereinafter relative to a preferred embodiment and the attached drawings.

DETAILED DESCRIPTION OF THE PREFERRED EMBODIMENTS

Figure 1:
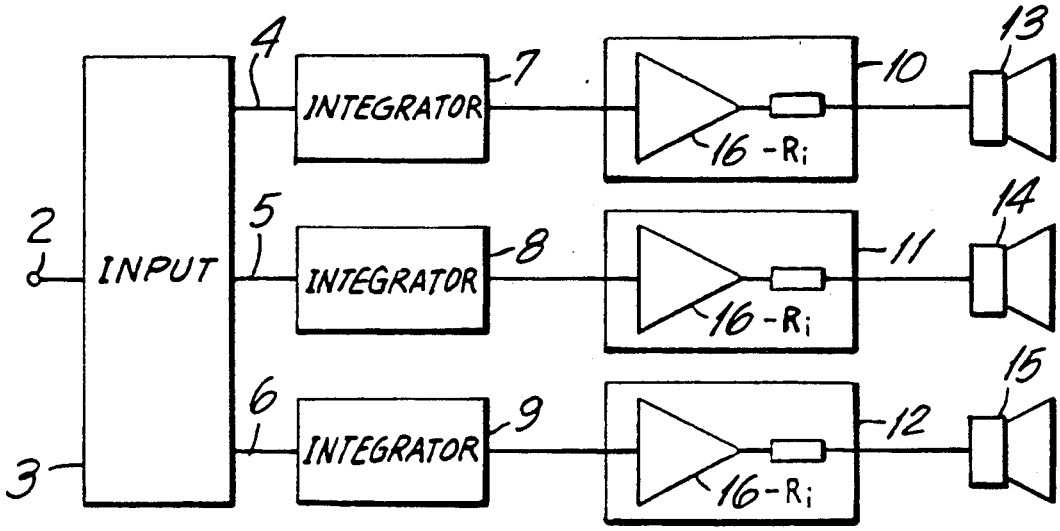
FIG. 1 is a diagrammatic representation of an electrodynamic loudspeaker according to the invention.

FIG. 1 shows an electrodynamic or moving-coil loudspeaker 1 in diagrammatic form with an input 2 for an electric signal, with a speaker dividing network or diplexer 3 with three outputs 4, 5 and 6, which are connected via in each case one integrator 7, 8 and 9 to a power amplifier 10, 11 and 12, to each of which is connected a speaker unit 13, 14 and 15. The integrators should be considered as correcting networks containing an integrator, because the characteristic thereof is not intended to correspond to that of an integrator over the entire frequency range and as is known per se. The power amplifiers 10, 11 and 12, e.g. comprise an operational amplifier 16 and a circuit for producing a negative source impedance $-R_1$, such as is e.g. known from U.S. Pat. No. 4,720,665. However, such a power amplifier can also have a different construction, provided that it has a negative source impedance. The diplexer 3 can be constructed in per se known manner. For example, such a diplexer is described in JEI Journal of the Electronics Industry, vol. 32, September, 1985, pp 38 to 44 and FIGS. 3 and 4 thereof. Such a diplexer with an input and two outputs then comprises at least one adder circuit with a positively counting and a negatively counting input and a filter. The filter input is possibly connected across a time lag unit to the positively counting input and the output of the filter with the negatively counting input of the adder circuit. If more than two outputs are required on the diplexer, then several such diplexers can be connected in series for two outputs. Conventional dynamic loudspeakers are provided as the speaker unit.

Figure 2:
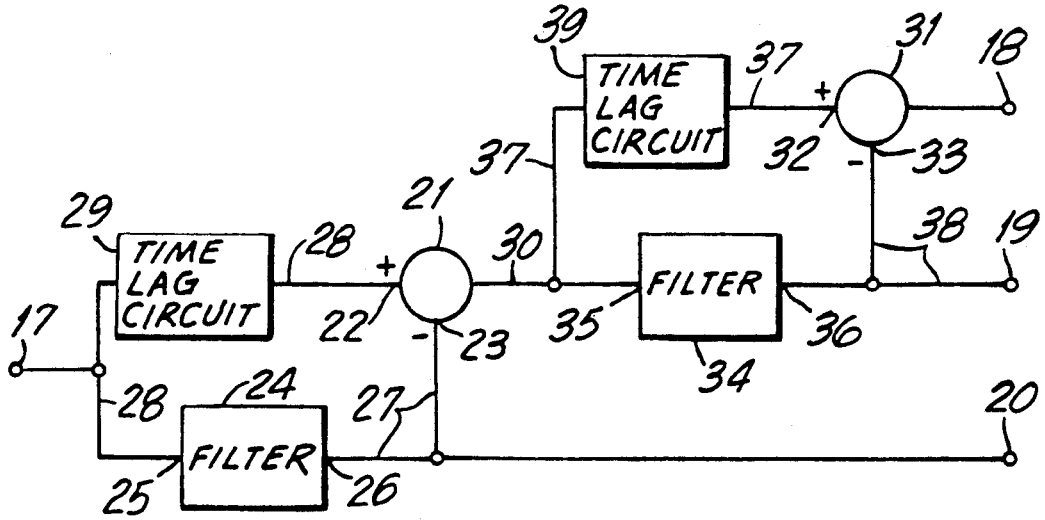
FIGS. 2, 3 and 4 show respectively three embodiments of a diplexer used in the speaker in diagrammatic form.

FIG. 2 shows a circuit of two diplexers connected in series and having an input 17 and three outputs 18, 19 and 20. The first diplexer includes an adder unit or circuit 21 with a positively counting input 22 and a negatively counting input 23, as well as a filter 24 with an input 25 and an output 26. Output 26 is connected across a line 27 to the negatively counting input 23 of the adder circuit 21 and to the output 20. Input 25 of filter 24 is connected across a line 28 and across a time lag unit 29 to the positively counting input 22 of the adder circuit 21, which also has an output 30. Thus, elements 17 and 21 to 30 form a first diplexer with two outputs 20 and 30. The second diplexer is connected in series to output 30 and has the same elements as the first diplexer. These are constituted by the adder circuit 31 with inputs 32, 33, a filter 34 with an input 35, an output 36 and lines 37, 38. A time lag circuit or unit 39 is connected in line 37.

Figure 3:
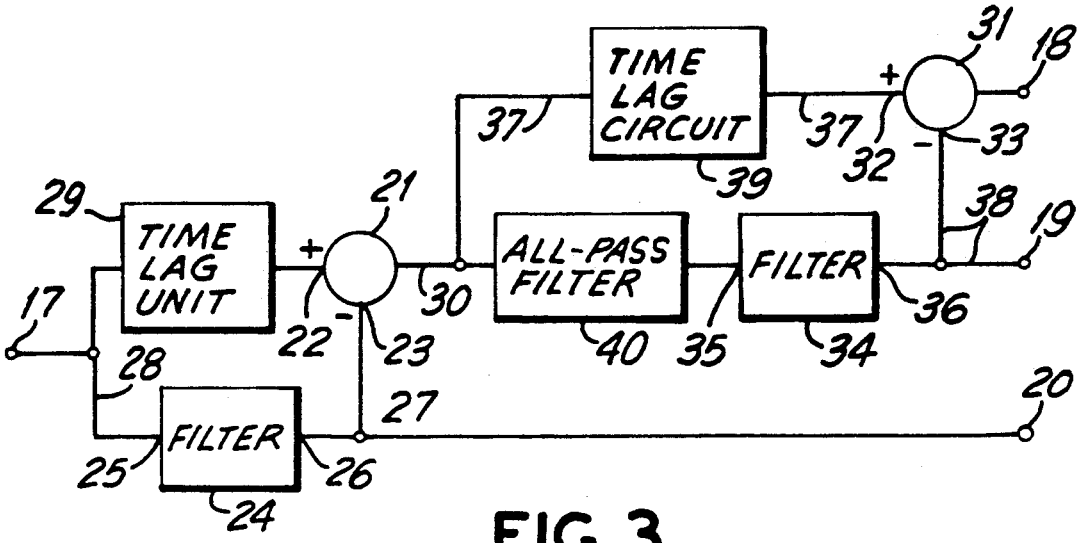

FIG. 3 shows a diplexer circuit having essentially the same elements as the diplexer circuit according to FIG. 2. It additionally contains a phase-correcting circuit 40 connected upstream of filter 34. The phase correcting circuit 40 is constructed as an all-pass filter.

Figure 4:
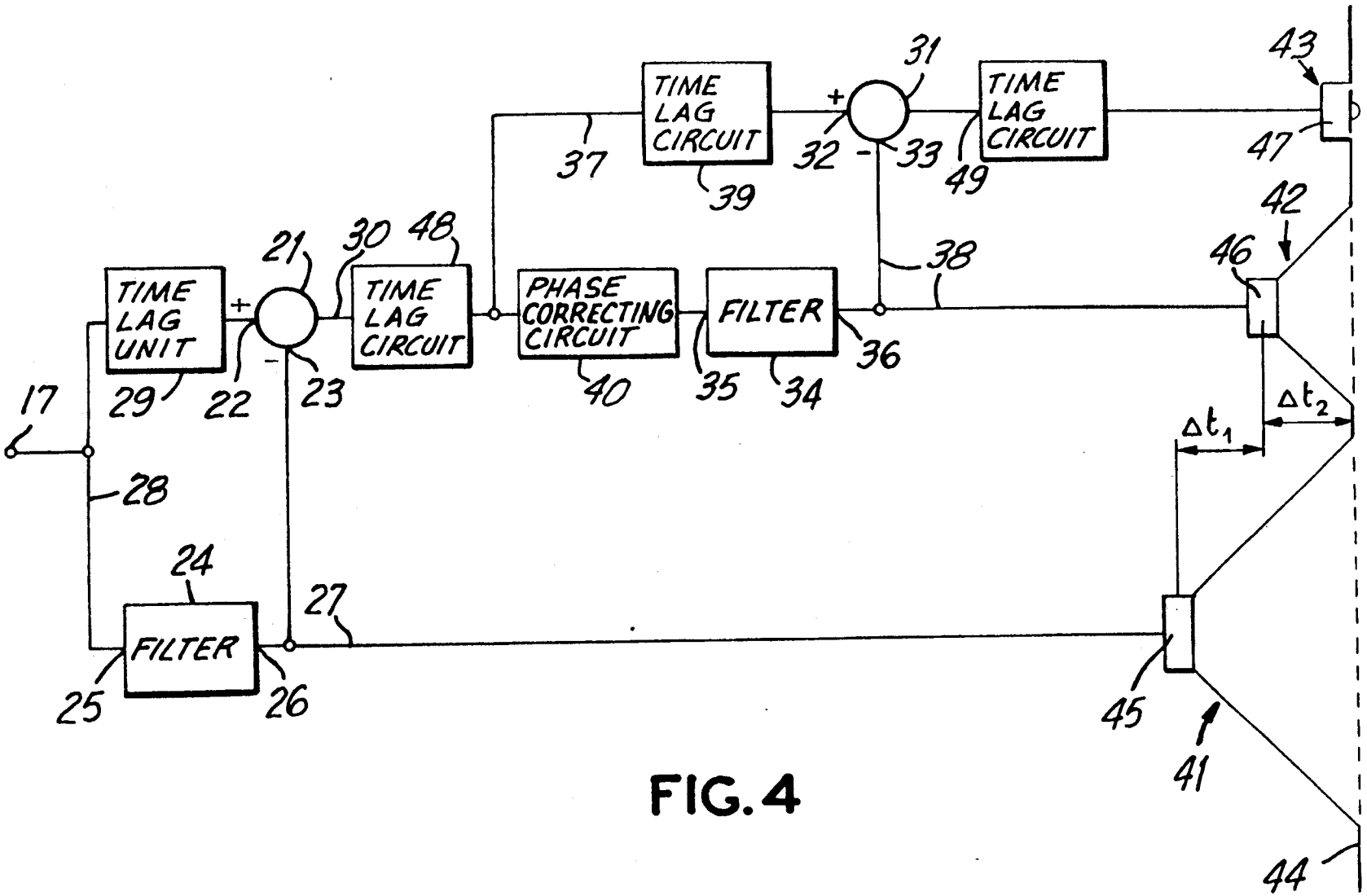

FIG. 4 shows another construction of a diplexer circuit with speaker units 41, 42 and 43 connected thereto and all of which issue into a common acoustic baffle 44. This means that their magnetic systems 45, 46, 47 have different distances from the acoustic baffle 44. If these distances are measured in propagation times of the sound waves, then the moving coil in magnetic system 45 of speaker unit 41 has a distance $\Delta t_1+\Delta t_2$, the moving coil in magnetic system 46 of speaker unit 42 has a distance of $\Delta t_2$ and the moving coil in magnetic system 47 of speaker unit 43 has a negligible distance. The not shown here power amplifiers and integrators which are shown in FIG. 1, are not essential for the purposes of this representation, but are still present in practice. The diplexer circuit once again has the same elements as mentioned in connection to FIGS. 2 and 3. These elements are consequently given the same reference numerals. However, new elements have been added, such as a time lag circuit 48, which is connected to the output 30 of adder circuit 21 and produces a time lag, which is dependent on distance $\Delta t_1$, as a time lag circuit 50 connected to an output 49 of adder circuit 31 and which produces a time lag dependent on distance $\Delta t_2$.

Figure 5:
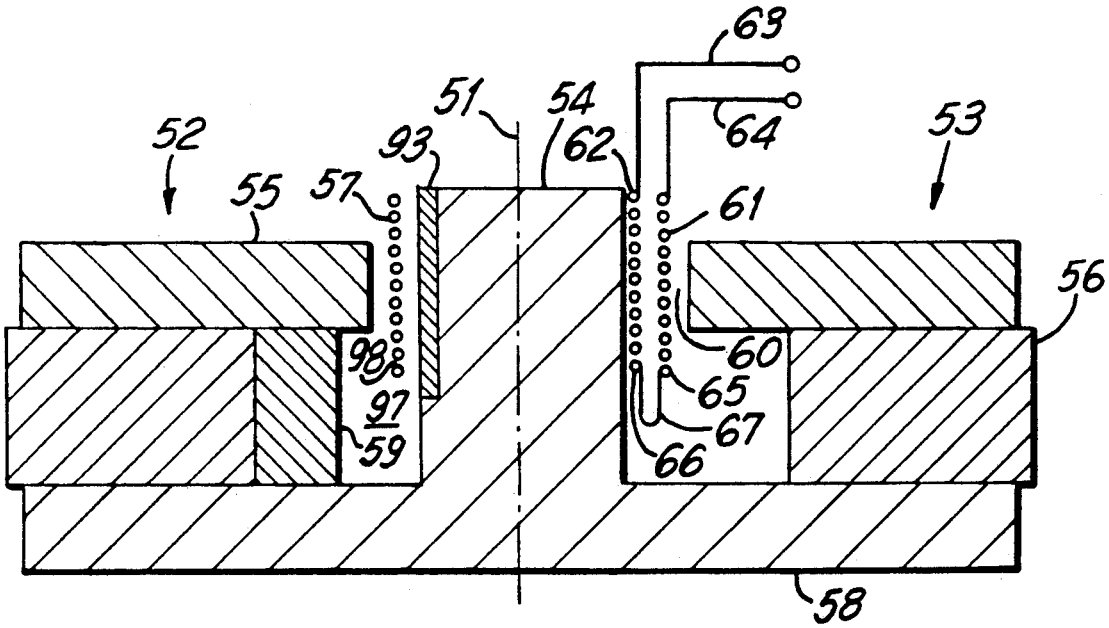
FIG. 5 is a section through a speaker unit.

FIG. 5 shows two symmetrical magnetic systems, namely system 52 to the left of a central line 51 and a magnetic system 53 to the right thereof. The construction of both magnetic systems 52, 53 is in part identical, so that the same elements can be given the same reference numerals. These include a pole piece 54, a pole plate 55 and a magnet 56. Magnetic system 52 has a moving coil 57, which is connected and supplied in per se known manner. Between pole plate 55 and pole piece 54, or more precisely an associated base plate 58 is inserted in per se known manner a copper short-circuit ring 59. A copper short-circuit ring 93 is also placed on pole piece 54 in the vicinity of moving coil 57.

A moving coil 61 is arranged in the magnetic system 53, which also has an annular air gap 60. Coaxial to moving coil 61, a further coil 62 is arranged in fixed manner on pole piece 54. There are various possibilities for connecting moving coil 61 and the further coil 62 to a power amplifier, so that only two terminals 63 and 64 are shown. One possibility is for one end 65 of moving coil 61 to be connected to the other end 66 of the further coil 62 and as indicated by line 67. However, preferably the further coil 62 is connected to the same power amplifier as moving coil 61, the two coils 61 and 62 having the same number of turns and being wound in opposite directions. The object of the further coil 62 is to produce a magnetic field acting in opposition at all times to the magnetic field produced by the current in moving coil 61 and compensating the same, so that the sums of these two magnetic fields is zero and consequently only the uniform magnetic field produced by magnet 56 appears in air gap 60.

Figure 6:
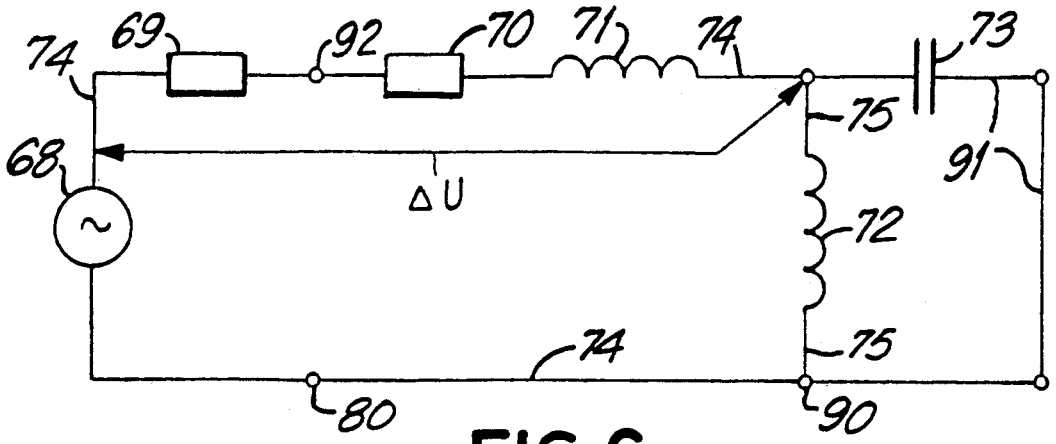
FIG. 6 is an electric equivalent circuit diagram of the speaker.

FIG. 6 shows a simplified electrical equivalent circuit diagram of a speaker with its supply. There is a power source 68, a negative resistor 69, a resistor 70, representing the ohmic resistance of the moving coil, an inductance coil 72 representing the mechanical restoring forces such as are produced by the suspension of the diaphragm and the air cushion in the speaker casing, and a capacitor 73 representing the masses of the diaphragm, etc. All these elements are interconnected by means of connection lines 74, 91 and connected in series, with the exception of inductance coil 72, which is connected in parallel to capacitor 73 and is connected across a line 75 to line 74, 91. Elements 68 and 69 together from the power amplifier and the remaining elements together form a speaker unit.

Figure 7:
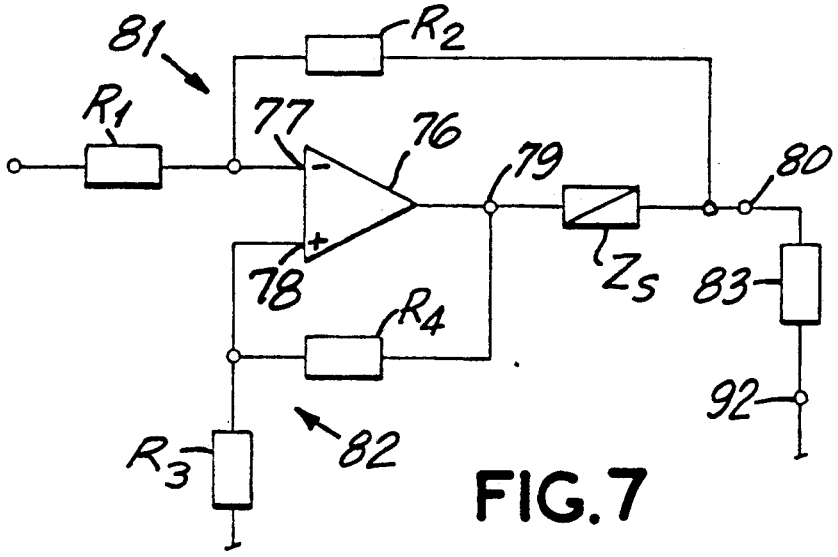
FIG. 7 is a circuit for producing a negative source impedance.

FIG. 7 shows an embodiment of a power amplifier circuit with a negative source impedance, such as can be used in FIG. 6 in place of the power source 68 and the negative resistor 69. It comprises an operational amplifier 76 with an inverting input 77, a non-inverting input 78 and an output 79, to which is connected an impedance $Z_s$. From its output 80, a feedback 81 with a resistor $R_2$ is returned to the input 77. This also includes a resistor $R_1$, which is connected to input 77. From output 79 a further feedback 82 with a resistor $R_4$ is returned to input 78 and is also connected across a resistor $R_3$ to ground. A load 83 is connected to output 80. In simplified form, this load represents the resistors, capacitors and inductance coils of the speaker units. These elements are 70, 71, 72, 73, 74, 75 and 91 in FIG. 6. The impedance $Z_q$ is the impedance occurring on the unloaded output 80. For the circuit according to FIG. 7, impedance $Z_s$ must be smaller than the resistors $R_2$ and $R_4$, and the impedance is $Z_q=-Z_s(1+V_1)/(V_2-V_1)$, where $V_1=R_2/R_1$ and $V_2=R_4/R_3$.

Figure 8:
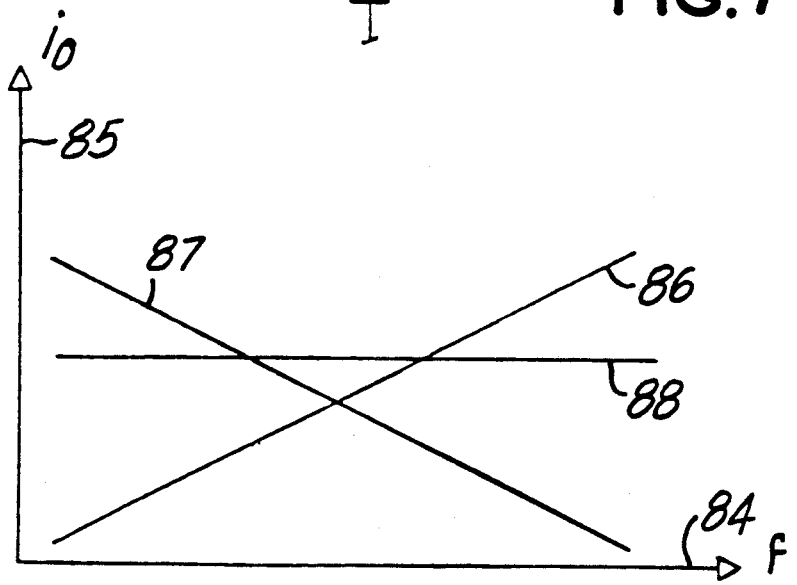
FIG. 8 is a graph representation of different characteristics.

FIG. 8 shows various frequency responses. On the horizontal axis 84 are plotted frequencies f and on the vertical axis 85 is plotted the acoustic output $i_o$, which can be understood to mean the sound pressure, output capacities, etc. A line 86 indicates a frequency response produced by the power amplifier 10, 11, 12 (FIG. 1) with the negative source impedance. A line 87 shows the frequency response produced by integrator 7, 8, 9 (FIG. 1). A line 88 shows the frequency response as produced by the series connection of the integrator and the power amplifier.

Figure 9:
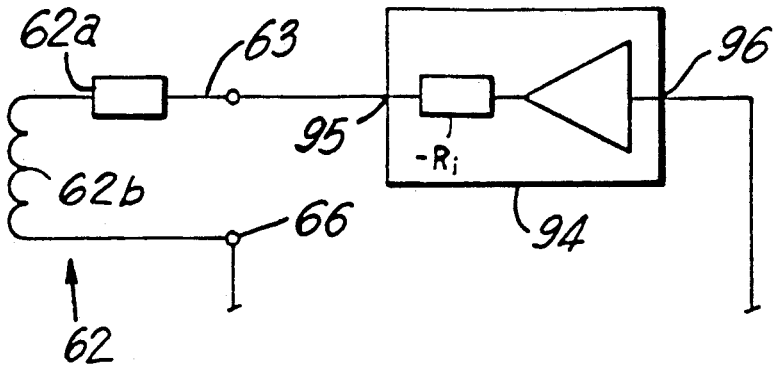
FIG. 9 is a circuit for a part of the speaker.

FIG. 9 shows a circuit such as can be used for the magnetic system 53 according to FIG. 5 together with the further coil 62. In this circuit, coil 62 is represented by an ohmic resistor 62*a* and an inductance coil 62*b*. Across a terminal 63 it is connected to the output 95 of an amplifier 94 with a negative source of impedance. Input 96 of amplifier 94 is connected to ground, as is also the other end 66 of coil 62.

Figure 10:
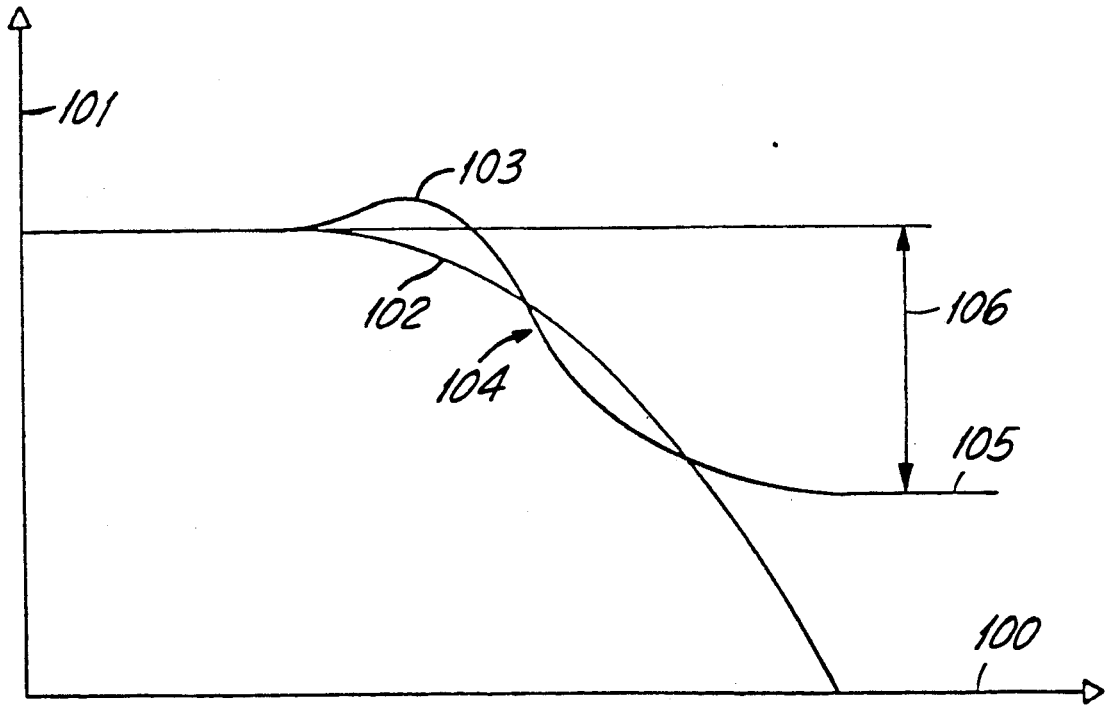
FIG. 10 is a filter characteristic graph.

FIG. 10 shows a frequency response such as can be provided for filter 24. On horizontal axis 100 are plotted the frequencies f and on vertical axis 101 the acoustic output $i_o$. A curve 102 represents a per se known filter characteristic for a low-pass filter of at least a second order Bessel function. A further curve 103 above a point 104 also represents a per se known filter characteristic for a low-pass filter of second order Butterworth function (provided that the quality precisely corresponds to $1/\sqrt{2}$) or Tchebycheff function (provided that the quality is higher than $1/\sqrt{2}$). According to the invention, after point 104, this characteristics passes out horizontally in an area 105, where the damping is substantially constant. The damping corresponding to a distance 106 should only be sufficient to ensure that the signal components passing through said filter and located in the frequency range of the loudspeaker unit 42 (medium-frequency range) do not detectably disturb the loudspeaker unit 41 (low-frequency range) or its output signal.

The operation of the loudspeaker according to the invention will now be described. It is advantageous to first deal with the operation with the aid of the electrical equivalent circuit diagram of FIG. 6. In the latter the inductance coil 72 represents the characteristics of the suspension of the diaphragm and the capacitor 73 the inertia of a loudspeaker unit diaphragm. A current corresponding to the acoustic output flows in line 91 and in simple and precise manner should be dependent on the voltage and frequency at power source 68. In the ideal case the voltage at node or junction 89 should correspond to the voltage at the power source 68. However, this would not appear to apply, because impedances 69, 70 and 71 are connected in series between the power supply 68 and nods 89 and a current flows through the same. Thus, at these impedances, voltage drops occur, the sum of which indicates a voltage difference U between power supply 68 and node 89. This voltage difference U can disappear, if the power supply 68 is directly connected to node 89. This also applies if the sum of the impedances 69, 70 and 71 is zero. This is achieved in that the impedance or resistor 69 has a magnitude corresponding to the negative sum of the impedance of the resistor 70 and the impedance or inductance coil 71. This makes it possible to completely eliminate the undesired influence of resistor 70, inductance coil 71 and also inductance coil 72 on the current in line 91, so that it also does not influence the frequency response and the distortions.

Such an impedance or resistor 69 with negative impedance together with a power amplifier is more precisely represented by the circuit according to FIG. 7. Resistor 83 represents the connected speaker unit. Output 80 and node 92 are given in both circuits for better orientation purposes (FIGS. 6 and 7). The circuit according to FIG. 7 functions as follows. Resistors $R_2$ and $R_1$ form the negative feedback 81 with the tendency to reduce the output signal at output 79. Resistors $R_3$ and $R_4$ form the positive feedback 82 with the tendency to increase the output signal at output 79. If no current flows at outputs 79 and 80, then the two outputs 79 and 80 have the same voltage, which is dependent on the size of resistors $R_1$ to $R_4$. On connecting in load 83, which means that the speaker unit is operating, then a current flows in impedance $Z_s$. Thus, the voltage at output 80 is somewhat smaller than at output 79. Therefore the positive feedback 82 is taken from a higher voltage than the negative feedback 81. Therefore the action of the positive feedback increases compared with the negative feedback and the signal at outputs 79 and 80 becomes greater. Greater loading at output 80 leads to a signal enlargement or magnification, which corresponds to a negative source impedance.

In the case of the inventive electrodynamic loudspeaker, such as is shown in FIG. 1, an alternating current signal is applied to input 2 and is so subdivided in the diplexer circuit that e.g. signal components with low frequencies pass across output 6 into integrator 9, signal components with medium frequencies across output 5 into integrator 8 and signal components with high frequencies across output 4 into integrator 7. These signal components are so treated in a per se known manner in said integrators, that their amplitudes decrease with rising frequency, as indicated by line 87 in FIG. 8. Following integrators 7, 8 or 9, said signal components pass into the power amplifiers 10, 11 and 12, where they acquire an amplitude/frequency characteristic according to line 86 in FIG. 8. As a result, a characteristic according to line 88 is obtained, or in fact a straight frequency response. The integrators and the power amplifiers with the negative source impedance are to be designed in such a way that the slopes of lines 86 and 87 are precisely the same in opposite directions and preferably the slope is 6 dB/octave. It would be conceivable to construct the power amplifier 10 for the high-frequency speaker unit 13 without a negative source impedance, but it is not then possible to produce the straight frequency response into the high-frequency range. However, this compromise could be accepted and the disadvantages ignored.

If an electrical signal is applied to the input 17 of the first diplexer 21 to 30 according to FIG. 2, then it passes via line 28 to input 25 of filter 24, which is constructed as a low-pass filter. The unfiltered signal is also applied via line 28 to the positively counting input 22 of adder circuit 21. The low frequencies are substracted from this signal in adder circuit 21 and only the high frequencies appear at output 30. The low frequencies then pass to output 20. Elements 31 and 34 of the second diplexer 31 to 39 operate in precisely the same way, so that the high frequencies occur at output 18, the medium frequencies at output 19 and the low frequencies at output 20. This also applies if filter 34 is constructed as a low-pass filter. Quite independently of whether or not time lag circuits 29 and 39 are provided, it is possible to achieve with such a diplexer that the signals from outputs 18, 19 and 20, which cross power amplifiers 10, 11 and 12 are supplied at loudspeaker units 13, 14 and. 15, together provide an acoustic output signal having a linear phase/frequency characteristic.

A significant improvement can be obtained if the time lag circuits 29 and 39 are designed in such a way that they precisely compensate the time lags of the signal in filters 24 and 34 and if said filters are constructed as low-pass filters of at least fourth order Bessel function. Then, at outputs 18, 19 and 20, signals are obtained allowing the loudspeaker units 13, 14 and 14, 15 to operate in-phase at the particular take-over frequency. This means that at any frequency of signals close to the upper critical frequency of the filter 24 constructed as a low-pass filter, the diaphragms of the speaker units 14 and 15 operate synchronously and without phase difference. Therefore the radiation characteristic of said two speaker units is stable. The same effect can be obtained for the take-over frequency of speaker units 13 and 14.

A simplification can be achieved if the filter 24 is constructed as a low-pass filter with two poles and a quality equal to or greater than $1/\sqrt{2}$ and if the falling frequency response of the filter is made such that it passes into a range with a substantially constant damping, as shown in FIG. 10. This is in opposition to a standard frequency response, which drops to infinite damping. This significantly shortens the group delay in filter 24, which significantly reduces the circuitry in the time lag circuit 29. In certain circumstances the time lag circuit 29 can be completely omitted. As a result of this simplification speaker units 14 and 15 operating close to the critical frequency of the filter 24 no longer operate precisely in-phase.

As can be seen from FIG. 3, the phase correcting circuit 40 can be connected upstream of filter 34, which leads to an improvement and a phase-linear and in-phase acoustic output signal. The filter 34 constructed as a-low-pass filter is preferably in the form of a second order Butterworth filter. The phase correcting circuit 40 must be designed in such a way that it influences the phase up to sufficiently high frequencies, which in particular include those close to the falling frequency response of filter 34. Thus, adder circuit 31 forms a high-pass filter with the steepness of a third order filter.

All the elements discussed above for the diplexer circuit are combined in the representation according to FIG. 4, to which have been added the two time lag circuits 48 and 50. Time lag circuit 48 delays the signal from output 30 by an amount which is such that the time lags of all the series-connected elements, such as time lag circuit 48, phase correcting circuit 40 and filter 34, when added up correspond to the time difference $\Delta t_1$. The signal supplied to input 2, 17 is formed from two partial signals, one partial signal being emitted across speaker unit 41 and the other across speaker unit 42. The time lag circuit 48 then ensures that both partial signals on passing through the acoustic baffle and on being converted into sound waves, leave the baffle 44 precisely in the way in which they are formed in the signal at input 2, 17. Thus, time lag circuit 50 precisely compensates for the time difference $\Delta t_2$ corresponding to the propagation time difference of the sound waves in speaker units 42 and 43 from the diaphragm to the acoustic baffle 44. In order to achieve the same effect, time lag circuits could also be provided at other points in the diplexer circuit.

Further improvements are possible to the inventive speaker by improvements to the magnetic system (cf. FIG. 5) of the individual speaker units 13, 14 and 15.

It is known that measures exist on a magnetic system aiming at improving the distribution of the magnetic field in the air gap. The aim of this improvement is to ensure that the decrease of the magnetic field strength at both ends of the air gap is continuous and symmetrical. This is e.g. achieved in that the pole piece 54 projects over the pole plate 55, so that nonlinear distortions during the movement of the moving coil are reduced. This reduction is in many cases not noticeable, because the nonlinear distortions produced by nonlinear restoring forces of the diaphragm suspension preponderate. This means that such improvements on the magnetic system are only appropriate if they are used together with the supply across power amplifiers with negative source impedance.

It is also known that the part 98 of moving coil 57 projecting into a cavity 97 (FIG. 5) leads to an additional energizing in the magnetic circuit as soon as current flows through it. The moving coil is subject to a force resulting from the vector product of the magnetic field and the current. Since, as stated, the magnetic field is a function of the current through the moving coil, the vector product becomes nonlinear. Therefore the magnetic field must be opposed. One possibility is offered by the short-circuit ring 59. Currents are always formed therein in such a way that the magnetic flux change is counteracted. A further possibility is to provide a coil in place of the short-circuit ring 59. It is energized by the current in the moving coil and therefore compensates for the undesired energizing by the lower part 98 of moving coil 57. It is also possible to short-circuit this coil and the action then corresponds to that of the short-circuit ring 59. If the ohmic resistance of said coil is prejudicial, it can be compensated in that the short-circuit takes place across a negative resistor. This means that the coil is connected to an amplifier with a negative source impedance. A circuit according to FIG. 9 is then obtained for this coil used in place of the short-circuit ring 59. However, amplifier 94 does not receive a signal at input 96. The amplifier 94 compensates the ohmic resistance **62*a* of coil 62*b***, so that the latter no longer has resistance and randomly high currents can flow therein, i.e. it is short-circuited. However, this improvement is also only noticeable when the distortions caused by the nonlinear restoring forces are eliminated.

It is known that the moving coil as a whole produces a magnetic field, which influences the magnetic field in the air gap 60 (FIG. 5) in such a way that, as a function of the polarity of the fields, there is a field amplification at one end of the air gap and a field weakening at the other. Initially this does not appear to represent a problem, because the total flow in the air gap remains constant. However, closer consideration shows that this is not the case. The permeability of the iron in pole plate 55 and in pole piece 54 is dependent on the magnetic modulation, so that the total magnetic flux is once again dependent on the current in the moving coil 61. The resulting distortions can be controlled by a short-circuit ring 93 in the vicinity of the air gap. A further possibility is the replacement of the short-circuit ring 93 by a fixed, further coil 62 positioned in such a way that it precisely eliminates the field produced by moving coil 61. To this end, the moving coil current preferably also flows through it. It is connected in series or parallel with the moving coil. It is also possible to supply coil 62 by a separate amplifier. It is also conceivable to connect the coil to an amplifier with a negative source impedance, as shown in FIG. 9. The improvements which are obtained through these measures are only fully effective on eliminating the dominant distortions caused by nonlinear restoring forces.

There has been disclosed heretofore the best embodiment of the invention presently contemplated. However, it is to be understood that various changes and modifications may be made thereto without departing from the spirit of the invention.

We claim:

1. Electrodynamic loudspeaker comprising:

a plurality of dynamically operating speaker units;

at least one diplexer unit for dividing an input frequency into more than one separate frequency ranges; and a plurality of power amplifiers, each being adapted to an associated one of said plurality of dynamically operating speaker units for receiving a signal in one of the separate frequency ranges, at least two of said power amplifiers having a negative source impedance characteristic adapted to substantially compensate for a voice coil impedance in each speaker unit for providing a linear frequency response over the entire audible frequency range, thereby minimizing distortion due to undesirable movements of the diaphragm not corresponding to driving electrical signals of respective power amplifiers.

2. Electrodynamic loudspeaker according to claim 1, wherein said speaker units have each a magnetic system including said voice coil, a magnetic flux of which is substantially independent of a current flowing through said voice coil.

3. Electrodynamic loudspeaker according to claim 1, wherein said diplexer unit is constructed in such a way that it supplies signals allowing said speaker units together to produce a phase-linear, acoustic output signal.

4. Electrodynamic loudspeaker according to claim 1, wherein said diplexer unit is constructed in such a way that it supplies signals allowing said speaker units to operate in-phase at a take-over frequency.

5. Electrodynamic loudspeaker according to claim 2, wherein said magnetic system further includes an additional coil, which is in-phase, but fixed with respect to said voice coil and which eliminates a magnetic field produced by said voice coil.

6. Electrodynamic loudspeaker according to claim 3, wherein said diplexer unit comprises an adder circuit having a positively counting input and a negatively counting input, and a filter, which are interconnected so that an input of said filter is connected to the positively counting input and an output of said filter is connected to the negatively counting input of said adder circuit.

7. Electrodynamic loudspeaker according to claim 6, wherein said filter is constructed as a low-pass filter with two poles, with a quality equal to or greater than $1/\sqrt{2}$ and a falling frequency response, which passes into a zone with substantially constant damping.

8. Electrodynamic loudspeaker according to claim 6, wherein said diplexer unit comprises a first and a second series-connected diplexer, each having said adder circuit and said filter, and wherein the filters of said first and second diplexers are low-pass filters; and further comprising a phase-correcting circuit connected into the filter of the second diplexer, and the filter of the second diplexer being designed in such a way that the adder circuit connected to the filter of the second diplexer acts as an at least third order high-pass filter.

9. Electrodynamic loudspeaker according to claim 6, further including a time lag circuit connected to said adder circuit, said time lag circuit at least partly compensating for propagation time differences between the magnetic systems of said speaker units and a common acoustic baffle of said speaker units.

10. Electrodynamic loudspeaker according to claim 2, wherein the negative source impedance of said power amplifiers compensates an ohmic resistor and an inductance coil of said voice coil of the connected speaker units.

11. Electrodynamic loudspeaker comprising:

at least two dynamically operating speaker units each connected to a respective power amplifier;

first means associate to each of said at least two power amplifiers for measuring an electrical output current of said power amplifier;

second means associated to each of said at least two power amplifiers for providing positive feedback from an output to an input of said power amplifier; and said second means cooperating with said first means thereby causing said power amplifiers to produce a negative source impedance;

further comprising correcting networks provided for at least two of said dynamically operating speaker units; and at least one diplexer unit connected to each of said speaker units.

12. Electrodynamic loudspeaker according to claim 11, further comprising means associated with each of said power amplifiers for providing negative feedback from the output to the input of said power amplifier, said means for measuring the electrical output current and said means for providing negative feedback being series-connected.

13. Electrodynamic loudspeaker comprising:

at least two dynamically operating speaker units each connected to a respective power amplifier and to at least one common frequency divider;

means associated to each of said at least two power amplifiers for measuring an electrical output current of each said power amplifier; and means connected to each of said power amplifiers and to said means for measuring an electrical output, for producing negative source impedance in each said power amplifier and compensating, to a large extent, the impedance of a voice coil in each speaker unit.

14. Electrodynamic loudspeaker comprising:

a diplexer unit;

a plurality of dynamically operating speaker units, each speaker unit being series-connected to a power amplifier, an integrator and the diplexer unit, wherein each speaker unit with the power amplifier and integrator connected thereto is designed for operating in a predetermined frequency band, wherein said power amplifiers have a negative source impedance characteristic for substantially compensating for an impedance of a voice coil in the connected speaker unit, and wherein said integrators have an amplitude/frequency characteristic complementary to such characteristic of the acoustical power output of the power amplifier and the loudspeaker unit connected thereto combined.

15. Electrodynamic loudspeaker comprising:

a dynamically operating speaker unit connected to a first power amplifier, both adapted for reproducing signals in a first frequency range;

at least one other dynamically operating speaker unit connected to a further power amplifier, both adapted for reproducing signals in a further frequency range; and said first power amplifier and said at least one further power amplifier having a negative source impedance characteristic for substantially compensating for an impedance of a voice coil in the connected speaker unit.

16. Electrodynamic loudspeaker for producing sound in an audible frequency range comprising:

a) a first dynamically operating speaker unit having a first voice coil impedance;

b) a first power amplifier adapted to and cooperating with said first dynamically operating speaker unit to produce signals in a first frequency range in the audible frequency range, and having a first negative source impedance substantially equal to the voice coil impedance;

c) at least one other dynamically operating speaker unit, each having a respective voice coil impedance;

d) at least one other power amplifier, each of said at least one other power amplifier being adapted to and cooperating with a separate one of said at least one other dynamically operating speaker unit to produce signals in a separate frequency range different than the first frequency range, and having a seaprate negative source impedance substantially equal to the respective voice coil impedance;

said first power amplifier and said at least one other power amplifier cooperating to provide a linear frequency response over the entire audible frequency range, thereby minimizing distortion due to undesirable movements of the diaphragm not corresponding to driving electrical signals of respective power amplifiers.

17. Electrodynamic loudspeaker comprising:

a) a plurality of dynamically operating speaker units;

b) a plurality of power amplifiers; and c) at least one diplexer unit connected to each of said dynamically operated speaker units across a respective one of said power amplifiers, at least two of said power amplifiers having a negative source impedance ($-R_1$), said diplexer unit being adapted to supply signals allowing said speaker units together to produce a phase-linear, acoustic output signal, said diplexer unit having an added circuit with a positively counting input and a negatively counting input, and also having a filter with a filter input and a filter output and being interconnected with said added, said filter input being connected to said positively counting input of said added, said filter output being connected to said negatively counting input of said added, said filter being a low-pass filter with two poles, with a quality equal to or greater than $1/\sqrt{2}$ and a falling frequency response which passes into a zone with substantially constant damping.

* * * * *